US005761591A

United States Patent [19]

Yamaguchi

[11] Patent Number: 5,761,591

[45] Date of Patent: Jun. 2, 1998

[54] DEVELOPING APPARATUS WITH MEANS FOR CARRYING DEVELOPER BY UTILIZING THE ACTION OF ELECTRIC FIELD CURTAIN

[75] Inventor: Chiseki Yamaguchi, Tokyo, Japan

[73] Assignee: NEC Corporation, Tokyo, Japan

[21] Appl. No.: 703,406

[22] Filed: Aug. 26, 1996

[30] Foreign Application Priority Data

Aug. 30, 1995 [JP] Japan ..... 7-221949

[51] Int. Cl.[6] ..... G03G 15/08

[52] U.S. Cl. ..... 399/289

[58] Field of Search ..... 399/289, 265, 399/266, 290, 291, 222, 252

[56] References Cited

U.S. PATENT DOCUMENTS

| | | | |
|---|---|---|---|
| 4,480,911 | 11/1984 | Itaya et al. | 399/289 X |
| 4,508,052 | 4/1985 | Kohyama | 399/289 X |
| 4,962,723 | 10/1990 | Hotomi | 399/266 |
| 4,994,859 | 2/1991 | Mizuno et al. | 399/266 |
| 5,323,214 | 6/1994 | Kai | 399/289 |

FOREIGN PATENT DOCUMENTS

| | | |
|---|---|---|
| 60-115962 | 6/1985 | Japan . |
| 63-12527 | 1/1988 | Japan . |
| 63-13068 | 1/1988 | Japan . |
| 63-13072 | 1/1988 | Japan . |
| 315875 | 1/1991 | Japan . |
| 594084 | 4/1993 | Japan . |

*Primary Examiner*—Sandra L. Brase

*Attorney, Agent, or Firm*—Sughrue, Mion, Zinn, Macpeak & Seas, PLLC

[57] ABSTRACT

A developer is stored in a developer storing section arranged above, below or beside an image carrier on which an electrostatic latent image is formed. A carrying path, provided on its surface with a mechanism to generate an electric field curtain, carries the developer from the developer storing section toward the image carrier. One end of the carrying path is arranged within the storing section and the other end, in the vicinity of the image carrier. As mechanism to generate the electric field curtain, a plurality of electrodes are buried in an insulating layer of the carrying path, and an A.C. voltage is applied from outside to these electrodes. A developing electrode section arranged at the end of the carrying path toward the image carrier, opposite to said image carrier and in a downward direction, develops the electrostatic latent image by making the developer carried over the carrying path adhere to the image carrier. The developer which did not adhere to the image carrier is recovered into the developer storing section via a recovering path. The recovering path here is arranged underneath and substantially in parallel to the carrying path.

23 Claims, 8 Drawing Sheets

DEVELOPING APPARATUS WITH MEANS FOR CARRYING DEVELOPER BY UTILIZING THE ACTION OF ELECTRIC FIELD CURTAIN

BACKGROUND OF THE INVENTION

1. Field of the Invention

The present invention relates to a developing apparatus, to be installed in an image forming system such as an electronic image forming apparatus or a printer, for developing electrostatic latent images formed on an image carrier such as a photosensitive element by using toner or any other powdered developer, and more particularly to a developing apparatus with means to carry powdered developer by utilizing the action of an electric field curtain.

2. Description of the Related Art

Conventional developing apparatuses with a mechanism to carry powdered developer, by utilizing the action of electric field curtain, are disclosed in the Gazettes of Japanese Patents Laid-open Nos. 63-13068, 63-13072, 60-115962, 63-12527, 3-15875 and 5-94084. These conventional developing apparatuses will be described below.

Referring to FIG. 1, in a conventional developing apparatus disclosed in the Gazette of the Japanese Patent Laid-open No. 63-13068, a flat electrode plate 10 formed by burying in an insulator a group of electrodes for generating the action of an electric field curtain is arranged opposite to a photosensitive drum 11 with a prescribed inclination. The grouped electrodes for generating the action of an electric field curtain connect to a three-phase A.C. power source 12 via lines 13. The electrode plate 10 is arranged in the opening, facing the photosensitive drum 11, of a storing section 15 in which a developer 14 such as toner is stored.

When a three-phase A.C. voltage of a prescribed level is applied from the three-phase A.C. power source 12 to the grouped electrodes buried in the electrode plate 10, a travelling wave of an electric field curtain in the direction of an arrow 17 is generated on the electrode plate. The developer 14 in the storing section 15, subjected continuously to attraction and repulsion due to the electric field curtain, is carried on the electrode plate 10 from the bottom thereof toward the photosensitive drum 11. Part of the developer 14 which is carried flies toward the photosensitive drum 11 and adheres to the drum 11. Accordingly an electrostatic latent image is developed. The remainder of the developer 14 climbs up the electrode plate 10 as far as it can go, drops into the storing section 15, and is again stored there. In this process, the photosensitive drum 11 is turning in the direction of an arrow 18.

In this conventional developing apparatus, since the electrode plate for generating an electric field curtain is arranged opposite to the photosensitive drum with the inclination, the hardware configuration is severely restricted and complicated. The overall hardware size is also enlarged, resulting in a significant cost increase. Furthermore, since the recovery of unused developer solely depends on natural dropping, the unused developer tends to scatter, and the scattered developer would adhere to non-image parts of the photosensitive element, inviting deterioration of the reliability of image formation.

Referring now to FIG. 2, a conventional developing apparatus disclosed in the Gazette of the Patent Laid-open No. 63-13072 is provided with a photosensitive drum 21 and a developing sleeve 22, which is a rotating body arranged opposite, and supplies a developer 20, to the photosensitive drum 21. A magnetic substance is arranged inside the developing sleeve 22. This developing apparatus is further equipped with a storing section 23 which holds the developing sleeve 22 in an opening and stores the developer 20. A toner feeding hopper 24 is also installed at the center of the ceiling part of the storing section 23. A feeder 25 for intermittent feeding of the developer 20 is further arranged at the junction between the hopper 24 and the storing section 23.

At the bottom of the storing section 23 is laid a repulsion type electric field curtain generating mechanism, which is driven by a two-phase A.C. power source 28. This mechanism is designed to be able to feed the developing sleeve 22 with the developer 20 while stirring it. A blade 26 is provided at the opening of the storing section 23 to adjust the adhering quality of the developer 20.

A developer recovering section 27 receives the developer 20 supplied from the toner feeding hopper 24 and recovers the unused developer 20 adhering to the developing sleeve 22, and stores them into the storing section 23. In this recovering section 27, too, is laid a repulsion type electric field curtain generating mechanism driven by the power source 28. Further, a bias power source 29 is connected to the developing sleeve 22.

The developer 20 fed from the hopper 24, together with the developer 20 recovered from the developing sleeve 20, while being subjected to continuous attraction and repulsion due to the action of the electric field curtain of the recovering section 27, is mixed and stirred as a result of dropping over a slope of the recovering section 27. This process causes the newly fed and recovered developer 20 to be stored into the storing section 23 while the newly fed developer 20 is being electrified.

This conventional developing apparatus involves the problems of complexity, large size and high cost of the hardware because the developer is carried and recovered by a mechanical device using a rotating body.

Referring to FIG. 3, a conventional developing apparatus disclosed in the Gazette of the Patent Laid-open No. 60-115962 has a toner carrier 32 which is arranged opposite to a photosensitive drum 31 at a certain distance and with an inclination and provided with a piezoelectric oscillator. A toner supplying section 34 to supply a developer 30 to the toner carrier 32 is arranged above the toner carrier 32.

A toner storing section 33 stores the developer 30 which drops from the toner carrier 32 and is recovered. Electric field curtain type developer carrying means 35 and 36 for supplying the developer 30 to the toner supplying section 34 are provided in the toner storing section 33. A toner layer forming blade 37 is intended to regulate the quantity of the developer 30 supplied from the toner supplying section 34.

The developer 30 is supplied from the toner supplying section 34 to the developing toner carrier 32. This toner carrier 32 makes the supplied developer 30 more readily adherable to the photosensitive drum 31 by causing a piezoelectric oscillator to oscillate in response to the application of a high frequency voltage. The balance between an electrostatic latent image on the photosensitive drum 31 and an electrostatic force due to the electrification of the toner enables the developer 30, while falling over the slope of the toner carrier 32, to develop the electrostatic latent image on the photosensitive drum 31.

The developer 30 which is not used in the developing process, after dropping from the toner carrier 32, is carried by the electric field curtain action of the electric field curtain type carrying means 35 and 36 from underneath the toner carrier 32 to the toner supplying section 34 to be used again for development.

This conventional developing apparatus as its developing process relies on the electrostatic balance occurring on the photosensitive drum according to gravity, toner oscillation and the electric charge of the toner, is extremely sensitive to changes in developing environment.

Referring now to FIG. 4, in a conventional developing apparatus disclosed in the Patent Laid-open No. 63-12525, a developing sleeve 42, which is a rotating body, is arranged opposite to a photosensitive element 41. This developing sleeve 42 is accompanied by a feeder 44 for feeding a developer 40 from a toner supplying section 43, and this feeder 44 is provided with a mechanism to generate an electric field curtain action. Thus two sheets 45 and 46 having grouped electrodes for generating the electric field curtain action are arranged opposite to each other, and the feeder 44 is configured so as to apply an A.C. voltage from a three-phase A.C. power source 47 to each of the sheets 45 and 46., A bias power source 48 is connected to the developing sleeve 42.

In this configuration, the developer 40 fed between the two sheets 45 and 46 for generating the electric field curtain action is carried toward the developing sleeve 42 while being subjected to repeated attraction and repulsion by the electric field curtain action generated by the sheets 45 and 46. In this while, the developer 40 has an effect to make coagulated particles break one another by the electric field curtain action, and is thereby carried smoothly to the developing sleeve 42. The developer 40 which is not used in the developing process is recovered into a toner recovering case 49.

This conventional developing apparatus inevitably involves the problems of large size, complexity and high manufacturing cost, since it comprises the developing sleeve which is the rotating body. Moreover, there is no mechanism to positively recover developer.

The Gazette of Patent Laid-open No. 3-15875 discloses another conventional developing apparatus, which has separate electric field curtain generating mechanisms for the developer carrying and developing purposes.

Still another conventional developing apparatus is disclosed in the Gazette of the Patent Laid-open No. 5-94084. This apparatus has a developing sleeve and a developer storing section, and grouped electrodes are arranged to generate an electric field curtain action in the developer storing section or the developing sleeve. The grouped electrodes to generate the electric field curtain action are divided into first and second groups of electrodes, which are stacked in two unparallel layers around the developer storing section or the developing sleeve, one on the inner side and the other on the outer side.

These conventional developing apparatuses present no solution to the problems of the large size, complexity and high cost of hardware.

SUMMARY OF THE INVENTION

An object of the present invention is to provide a developing apparatus which can be realized in a small and thin configuration.

Another object of the invention is to provide a developing apparatus capable of improving the reliability of the developing process in an image forming system.

In order to achieve the above-stated objects, a developing apparatus according to the invention for developing electrostatic images formed on an image carrier by adhering a developer carried from storing means to the image carrier, comprises means for carrying the developer from the storing means to the image carrier with generating an electric field curtains electrode means, arranged at the end of the carrying means toward the image carrier in a state opposing the image carrier and in a downward direction, for adhering the developer carrier by the carrying means to said image carrier; and recovering means for recovering the developer which drops from the electrode means and carrying the developer to said storing means.

BRIEF DESCRIPTION OF THE DRAWINGS

The above-mentioned and other objects, features and advantages of the present invention will become more apparent from the following detailed description when taken in conjunction with the accompanying drawings, wherein.

DETAILED DESCRIPTION OF THE PREFERRED EMBODIMENTS

Figure 1:
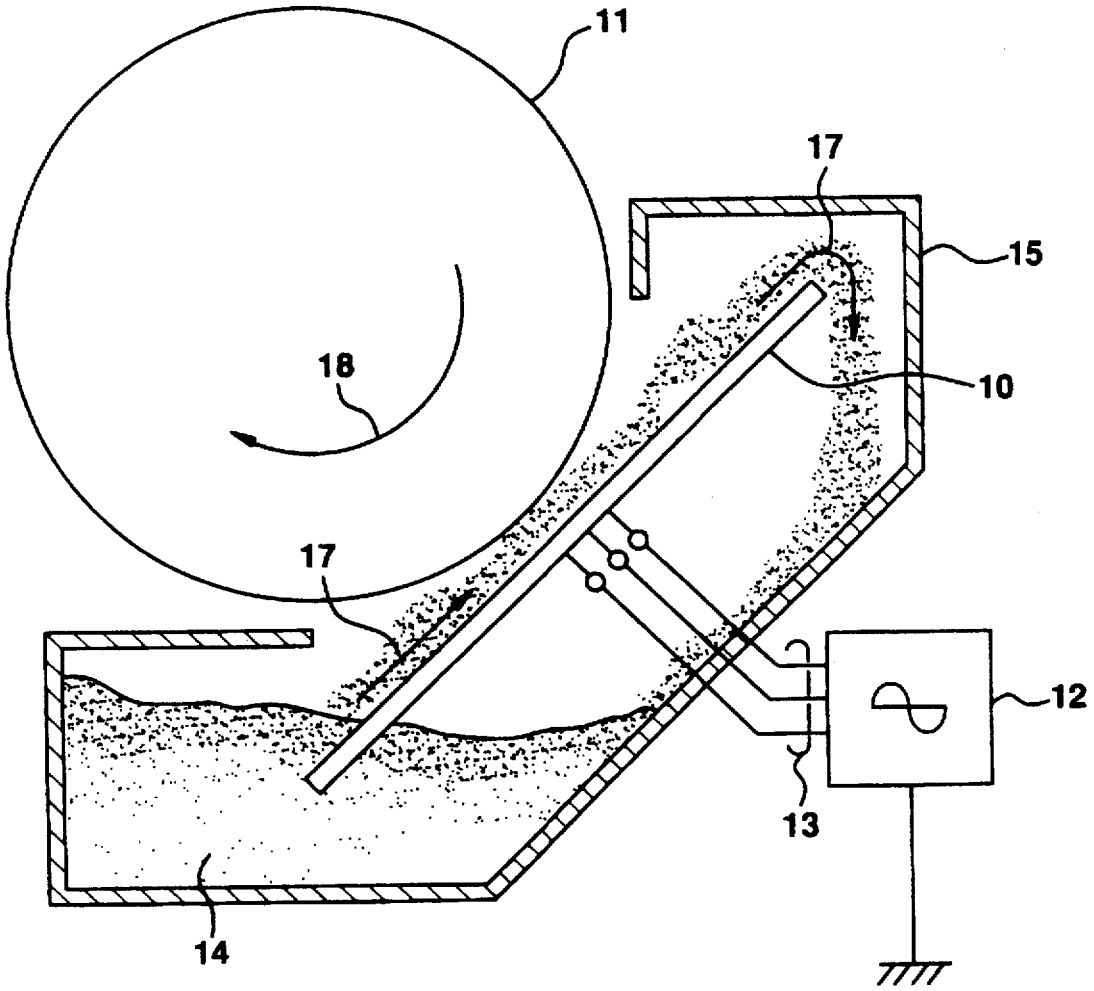
FIG.1 PRIOR ART
FIG. 1 is a diagram showing the configuration of a conventional developing apparatus.
Figure 2:
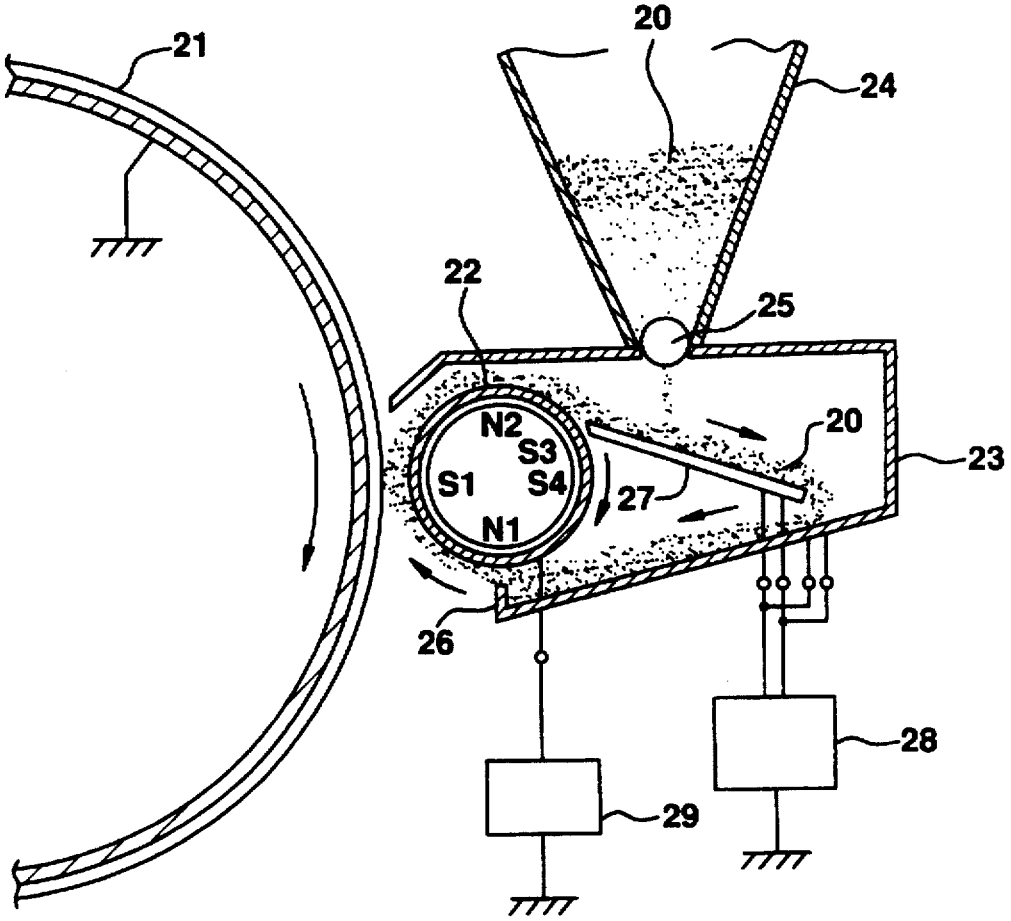
FIG.2 PRIOR ART
FIG. 2 is a diagram showing the configuration of another conventional developing apparatus.
Figure 3:
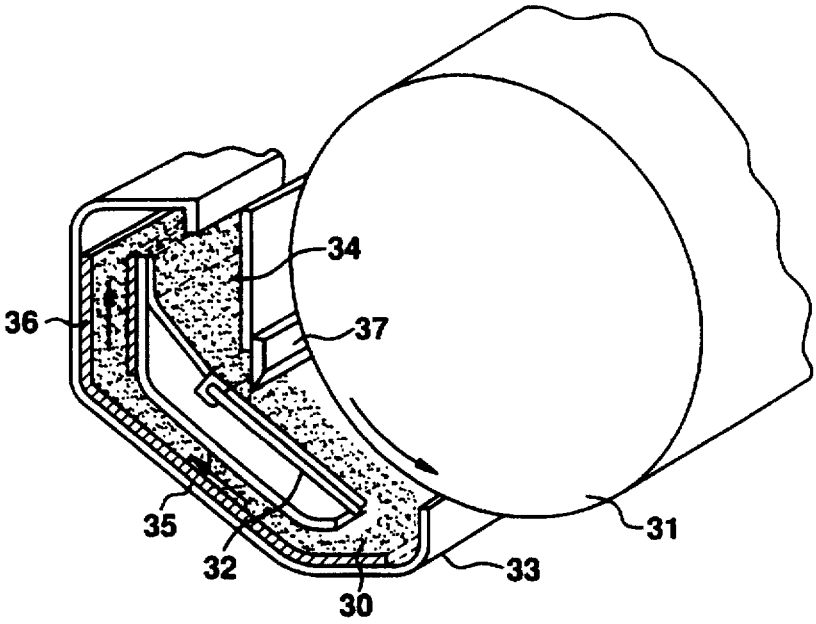
FIG.3 PRIOR ART
FIG. 3 is a diagram showing the configuration of still another conventional developing apparatus.
Figure 4:
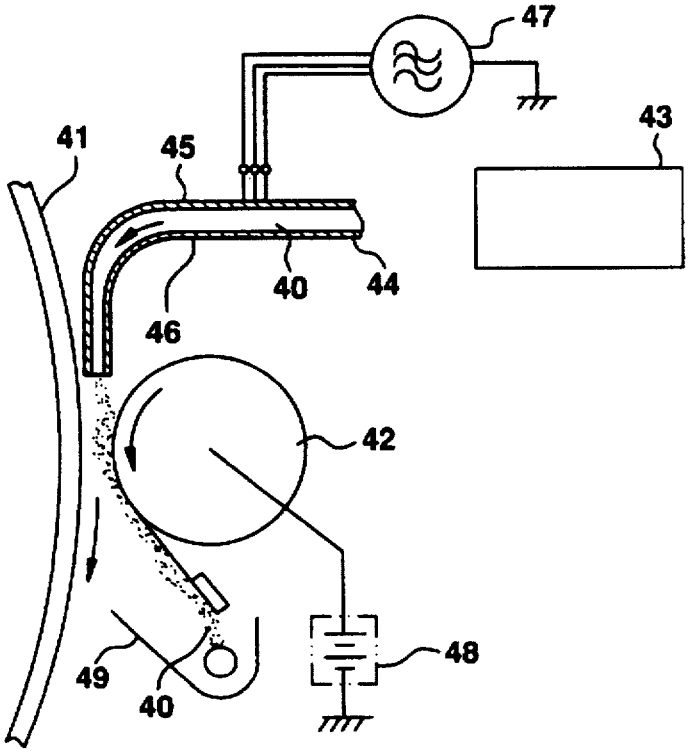
FIG.4 PRIOR ART
FIG. 4 is a diagram showing the configuration of yet another conventional developing apparatus.

A first preferred embodiment of the present invention will be described with reference to FIGS. 5 through 7.

A developer storing section 102 is provided at a prescribed distance from a drum-shaped image carrier 101, which may be a photosensitive drum for example. The developer storing section 102 is arranged in a position lower than the image carrier 101, which incidentally need not be drum-shaped but may be belt-shaped.

Between the developer storing section 102 and the image carrier 101 are arranged a carrying path 103 for carrying a developer 100 from the developer storing section 102 to the image carrier 101 and a recovering path 104, provided below the carrying path 103, for recovering the unused developer 100*a* and returning it to the developer storing section 102. The carrying path 103 is formed in a plate shape having a prescribed width, and inclined from the image carrier 101 side toward the developer storing section 102 arranged in a lower position than the image carrier 101. The carrying path 103 is bent toward the developer storing section 102, and the part of the carrying path 103 beyond the bend toward the developer storing section 102 is inclined more steeply than the rest of the carrying path 103. Within the carrying path 103 are provided a plurality of electrodes 201 (FIG. 6) for generating an electric field curtain over the surface of the carrying path 103 on which the developer 100 is carried.

Figure 6:
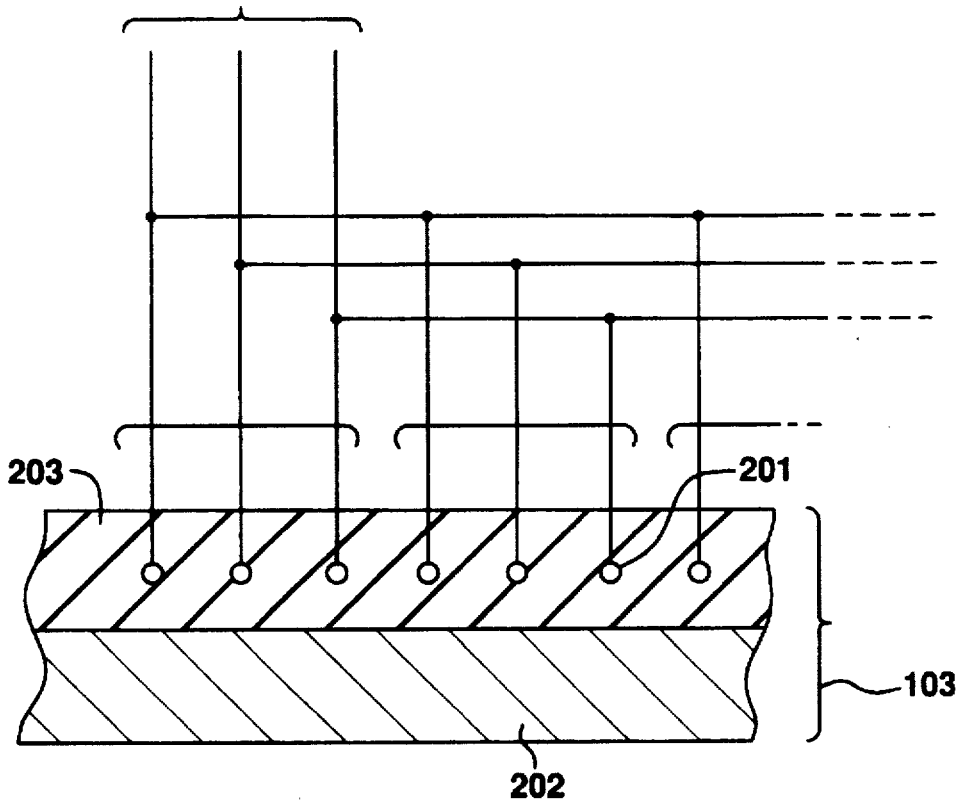
FIG. 6 is a diagram showing the configuration of the carrying path in the first embodiment of the invention.

Referring to FIG. 6, the carrying path 103 has a configuration in which a stacked insulating layer 203 is formed over a supporting substrate 202 formed of either metal or resin. A plurality of groups of three electrodes 201 each, which generate the action of an electric field curtain, are consecutively buried within the insulating layer 203. The electrodes 201 are formed of wires or thin sheet members.

By applying different phases of an A.C. voltage to the plurality of electrodes 201 buried in the insulating layer 203 from a power source 105, which may be a three-phase A.C. power source for instance, an electric field curtain, which travels upward from the bottom of the carrying path 103, i.e. from the developer storing section 102 toward the image carrier 101, is generated over the surface of the carrying path 103. This arrangement enables the developer 100 to be carried upward, i.e. toward the developing position on the image carrier 101 side, while being stirred and charged by the action of the electric field curtain.

At the end of the carrying path 103 toward the image carrier 101 is provided a developing electrode section 106, opposite to the image carrier 101 and directed downward. The developing electrode section 106 is arranged in a position at a few millimeters' distance to the image carrier 101 at the end of the carrying path 103. A developing bias for generating a developing electric field is constantly fed to the developing electrode section 106 from a developing power source 107. The developing electrode section 106 consists of metal, and its surface is coated with a thin film or otherwise appropriately treated to facilitate smooth carriage of the developer 100 and to prevent the developer 100 from adhering to its surface.

Figure 7:
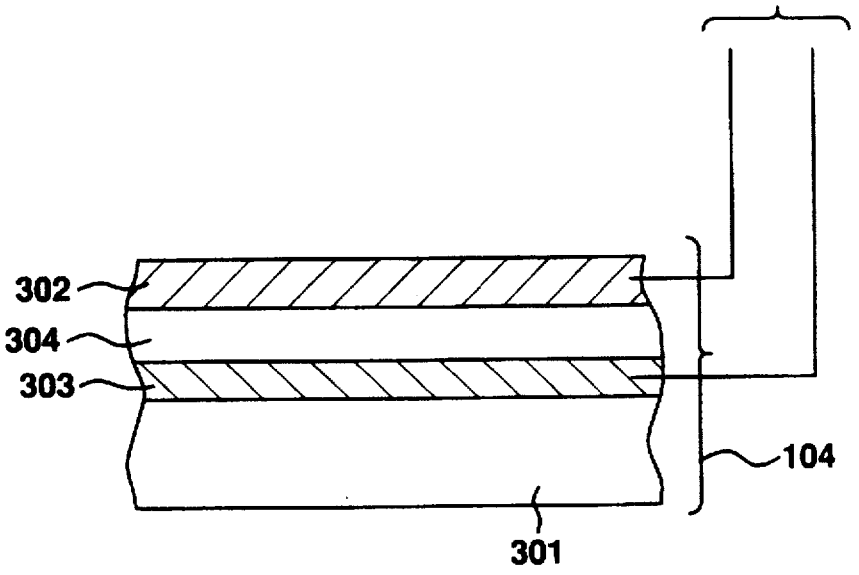
FIG. 7 is a diagram shoving the configuration of the recovering path in the first embodiment of the invention.

Referring now to FIG. 7, the recovering path 104 has a configuration in which a vibrating mechanism having a ceramic-stacked piezoelectric element 304 is arranged between electrodes 302 and 303 over a sheet-shaped supporting substrate 301 formed of either metal or resin, and is arranged underneath and substantially in parallel to the carrying path 103. The vibrating mechanism is intended to vibrate the recovering path 104.

When a prescribed high frequency voltage is applied from a power source 108 to the electrodes 302 and 303 arranged to sandwich the piezoelectric element 304 in-between, the recovering path 104, especially its top face side, is vibrated. This causes the developer 100*a* having dropped onto the recovering path 104 and been recovered move, while being properly vibrated, over the recovering path 104 downward, i.e. toward the developer storing section 102, into which it is recovered.

The developing electrode section 106 is caused by the application of a bias from the power source 107 to supply a voltage of the same electric polarity as that of the latent image formed on the image carrier 101. Near the carrying path 103 is provided a developer layer thickness regulating plate 109 for regulating the layer thickness of the developer 100 carried from the developer storing section 102. Further in the position where the developer 100 is recovered from the recovering path 104 to the developer storing section 102, there is fitted a recovery sheet 110 formed of a thin film of resin, such as urethane, to prevent the developer 100 from leaking out of the developer storing section 102. The recovering path 104 is fitted to the developer storing section 102 via a seal pad 111 formed of porous resin.

Toner of 5 to 15 μm in grain size, mainly consisting of styrene acryl or polyester resin is used as developer 100, and the image carrier 101 consists of an organic photosemiconductor, so-called organic photosensitive material.

Next will be described the operation of the first preferred embodiment of the present invention.

When the image forming system into which the developing apparatus, which is this particular embodiment of the invention, is incorporated starts operation, a prescribed three-phase A.C. voltage is applied from the power source 105 to the group of electrodes 201 which are arranged within the carrying path 103 and intended to generate an electric field curtain action. The developer 100 in the developer storing section 102 is carried over the carrying path 103 toward the developer layer thickness regulating plate 109. The developer 100 on the carrying path 103 undergoes layer thickness regulation by the developer layer thickness regulating plate 109, and is carried over the carrying path 103 further toward the developing electrode section 106.

In this while, the developer 100 is electrically charged as it is carried. The developer 100 carried to the developing electrode section 106 jumps and adheres to the image carrier 101 to develop a electrostatic latent image thereon by a developing electric field formed between a surface charge on the image carrier 101 and a developing bias applied from the power source 107 to the developing electrode 106. The latent image on the image carrier 101 is developed into a visible image the visible image is transcribed to a recording medium or the like.

Meanwhile, the developer 100*a* which has not adhered to the image carrier 101 drops from the developing electrode section 106 and proceeds toward the recovering path 104. Over the upper surface of the recovering path 104, which is inclined and vibrates as excited by a high-frequency voltage from the power source 108, the developer 100 is carried toward the recovery sheet 110, and recovered into the developer storing section 102. The developer 100 recovered into the developer storing section 102 will be used for development again. The operation of the developing apparatus thereafter continues by repeating the above-described sequence.

In this process, respectively appropriate values are set for the three-phase A.C. voltage output to be fed from the power source 105 to the group of electrodes 201 in the carrying path 103, the peak-peak value $V_{p-p}$ out of the range of 200 volts (V) to 10 kilovolts (kV) and the frequency out of the range of 10 hertz (Hz) to 500 hertz (Hz), according to the configuration of the electrodes to generate the electric field curtain action, the powder characteristics or the developing speed of the developer to be used, and other factors. For the output to be applied from the power source 108 to the electrodes 302 and 303 of the recovering path 104, the peak-peak value $V_{p-p}$ is set appropriately somewhere between 1 volt (V) and 500 volts (V), and the frequency, between 1 kilohertz (kHz) and 50 megahertz (Miz.), according to the shape of the piezoelectric element, the powder characteristics of the developer to be used, the shape of the recovering path, and the travelling speed of the developer among other factors.

In this way, the developing apparatus which is the first preferred embodiment of the present invention can carry the developer 100 and develop electrostatic latent images without using any mechanical power such as motor output. Furthermore, the use of the plate-shaped carrying path 103 and recovering path 104 to carry and recover the developer 100, respectively, has made it possible to substantially reduce the size of the mechanism to carry the developer 100 between the developer storing section 102 and the image carrier 101. Therefore, any image forming system equipped with the developing apparatus which is the first preferred embodiment of the invention can be made smaller and thinner as otherwise.

The possibility to adhere the developer 100 to the image carrier 101 and to recover the unused developer 100*a* without using any mechanical power makes the system easily and smoothly adaptable to any change in the developing process, such as the addition of a new function, optimization of the operation or any change in operating environment. Since the adjustment of the quantity of the developer 100 and the charging process of the developer 100 are smoothly accomplished by the electric field curtain action on the carrying path 103, the picture quality can be improved and stabilized. Accordingly, the image forming system using this developing apparatus can in itself be enhanced in reliability.

Figure 8:
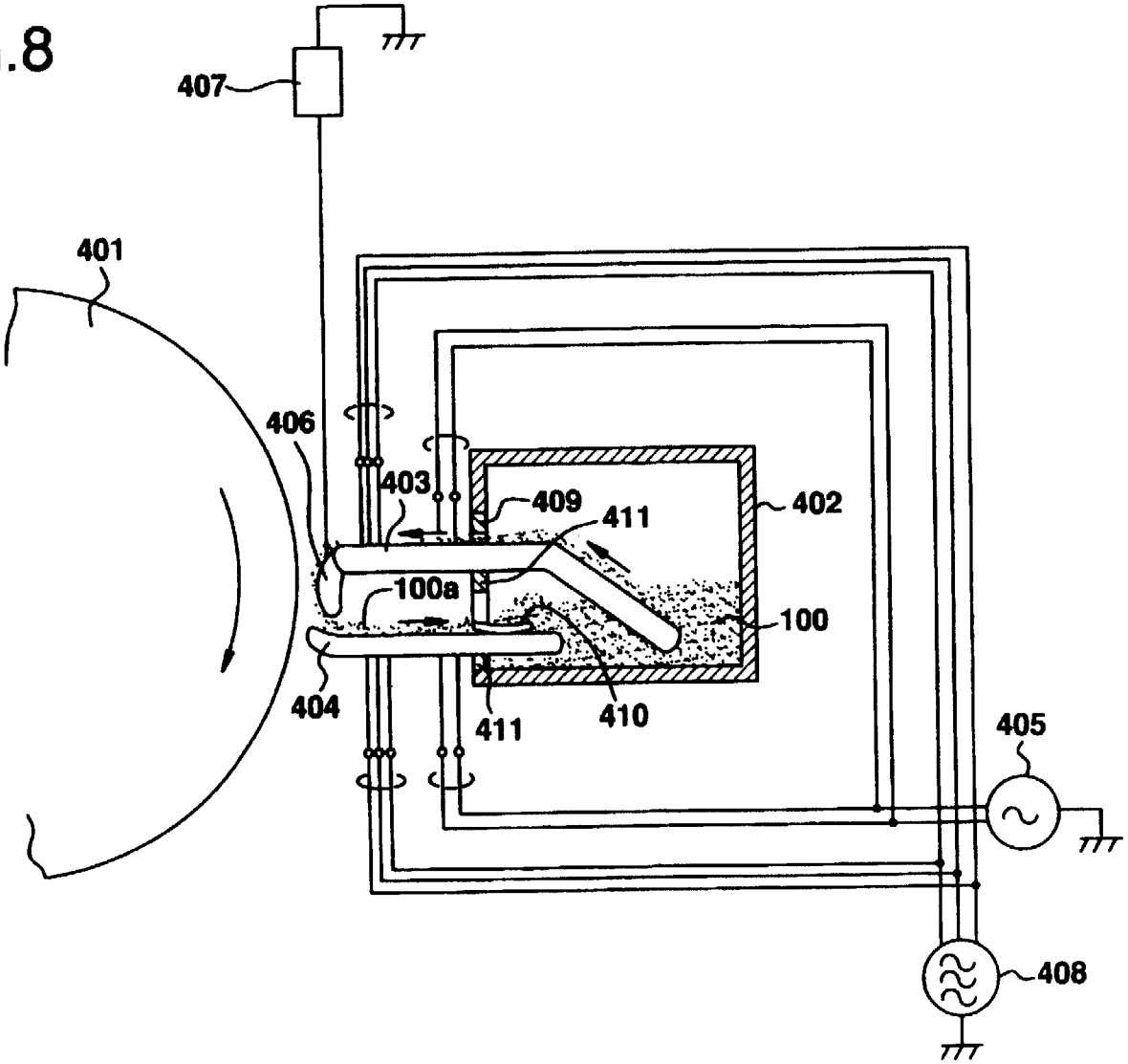
FIG. 8 is a diagram showing a second embodiment of the present invention.

Next will be described a second embodiment of the present invention with reference to FIGS. 8 and 9.

A developer storing section 402 is provided at a prescribed distance from a drum-shaped image carrier 401, which may be a photosensitive drum for example. Incidentally, the image carrier 401 need not be drum-shaped, but may be belt-shaped. The developer storing section 402 is arranged in a position about as high as and beside the image carrier 401. Between the developer storing section 402 and the image carrier 401 are arranged a carrying path 403 for carrying a developer 100 from the developer storing section 402 to the image carrier 401 and a recovering path 404, provided below the carrying path 403, for recovering the unused developer 100*a* and returning it to the developer storing section 402. The recovering path 404 is arranged substantially in parallel to the carrying path 103 and substantially horizontally.

The carrying path 403 is formed in a plate shape having a prescribed width, and arranged substantially horizontally from the image carrier 401 side toward the developer storing section 402. The carrying path 403 is bent toward the developer storing section 402, and the carrying path 403 beyond the bend toward the developer storing section 402 forms a slope having a prescribed angle of inclination. This arrangement makes it easier for the developer 100 located at the bottom of the developer storing section 402 to be carried outward. Within this carrying path 403 are provided a plurality of electrodes for generating an electric field curtain over the surface on which the developer 100 is carried.

Figure 9:
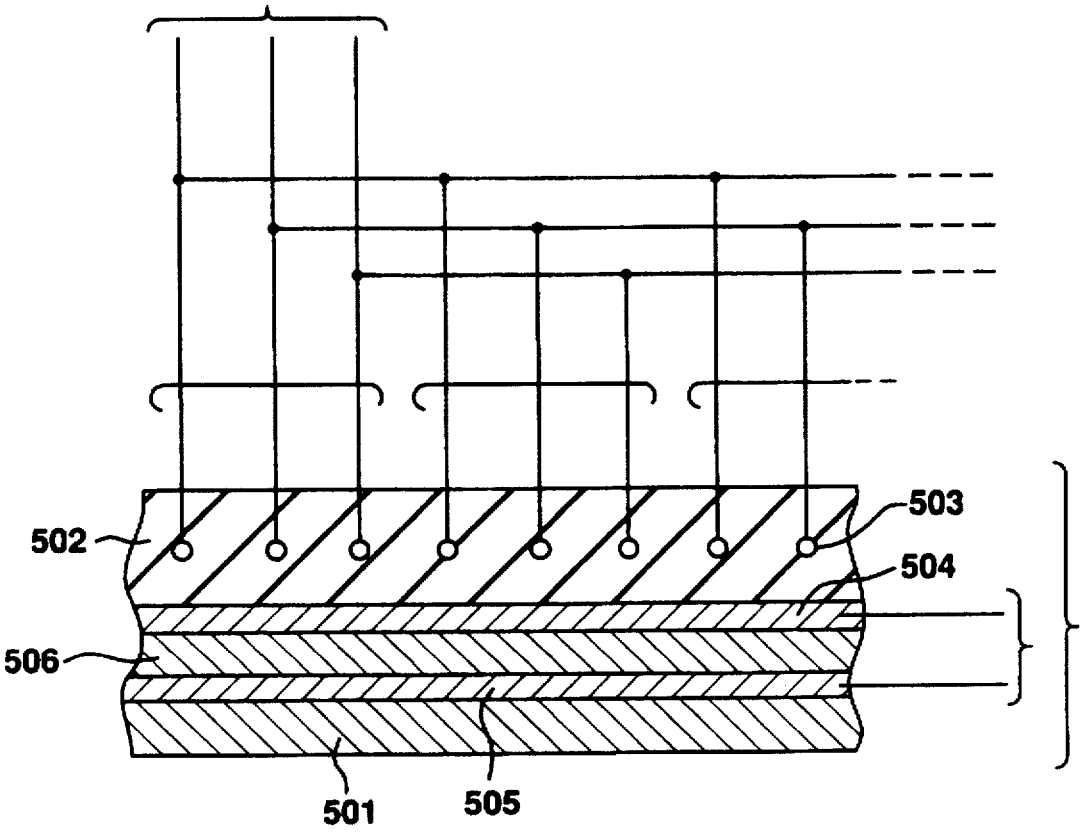
FIG. 9 is a diagram showing the configuration of the carrying and recovering paths in the second embodiment of the invention.

Referring to FIG. 9, the carrying path 403 is provided with a supporting substrate 501 formed of metal or resin and an insulating layer 502 stacked on this supporting substrate 501. A plurality of groups of three electrodes 503 each, which generate the action of an electric field curtain, are consecutively buried within the insulating layer 502. The electrodes 503 are formed of wires or thin sheet members. Between the supporting substrate 501 and the insulating layer 502 is stacked a vibrating mechanism consisting of a piezoelectric element 506 and its electrodes 504 and 505. Thus, the carrying path 403 have a structure in which the carrying path 103 and the recovering path 104, respectively illustrated in FIGS. 6 and 7, are integrated.

An electric field curtain action, which travels from the developer storing section 402 toward the image carrier 401, is generated by applying different phases of an A.C. voltage to the electrodes 503 buried in the insulating layer 502 from a power source 405, which is a three-phase A.C. power source. The developer 100 is carried to the developing position of the image carrier 401 while being stirred and charged by the action of the electric field curtain.

The recovering path 404 has a similar stacked structure to that of the carrying path 403. The power source 405 is connected to the electrodes 503 for generating the electric field curtain action so that the travelling direction of the developer is contrary between the carrying path 403 and the recovering path 404. This can be readily realized by connecting the power source 405 so that the feeding sequences of the three-phase A.C. voltage are reverse to each other. Accordingly, the power source 405 for generating the electric field curtain is used as a common three-phase power source for the carrying path 403 and the recovering path 404. Furthermore, a power source 408 for feeding a high-frequency power to the electrodes 504 and 505 of the vibrating mechanism are similarly shared by the carrying path 403 and the recovering path 404.

Incidentally, the carrying path 403 and the recovering path 404 are fitted to the developer storing section 402 via a seal pad 411 formed of porous resin. The developer storing section 402 has a regulating plate 409, arranged near the carrying path 403, for regulating the layer thickness of the developer 100 carried over the carrying path 403. In the position where the developer 100 is recovered from the recovering path 404 into the developer storing section 402, a recovery sheet 410 is installed to prevent the developer 100 from leaking out of the storing section 402.

At the end of the carrying path 403 toward the image carrier 401 is provided a developing electrode 406, opposite to the image carrier 401 and directed downward. a developing bias for generating a developing electric field is fed to the developing electrode 406 from a developing power source 407.

Next will be described the operation of the second embodiment of the present invention.

Upon the start of image forming operation, prescribed voltages are applied from the exclusive power sources 405 and 408 to the group of electrodes 503 for electric field curtain generation and the electrodes 504 and 505 of the vibrating mechanism, which are arranged within the carrying path 403 and the recovering path 404, respectively. The developer 100 is carried to the developing electrode 406 while being stirred and charged by the action of the electric field curtain and the vibration of the vibrating mechanism, and used in the developing process as in the operation of the first preferred embodiment of the present invention illustrated in FIG. 5. As a result, a visible image is formed on the surface of the image carrier 401. The visible image developed on the image carrier 401 is transcribed to a recording medium or the like.

Meanwhile, the developer 100*a* which has not been used in the development proceeds toward the recovering path 404, and recovered into the developer storing section 402 while being stirred by the action of the electric field curtain generated on the recovering path 404 and the vibration of the vibrating mechanism. The recovered developer 100 will be used for development again. The operation of the developing apparatus thereafter continues by repeating the above-described sequence. Incidentally, respectively appropriate values are set for the outputs from the power sources to be applied to the electrodes in the carrying path 403 and the recovering path 404 under the same conditions as for the first preferred embodiment of the invention described above.

This second embodiment of the present invention makes it possible to reduce the overall size of the developing apparatus because the carrying path 403 and the recovering path 404 need not be inclined. Furthermore, the absence of adjustment, which would be needed to arrange the carrying path and the recovering path with inclinations contributes to the ease of production and maintenance.

Figure 10:
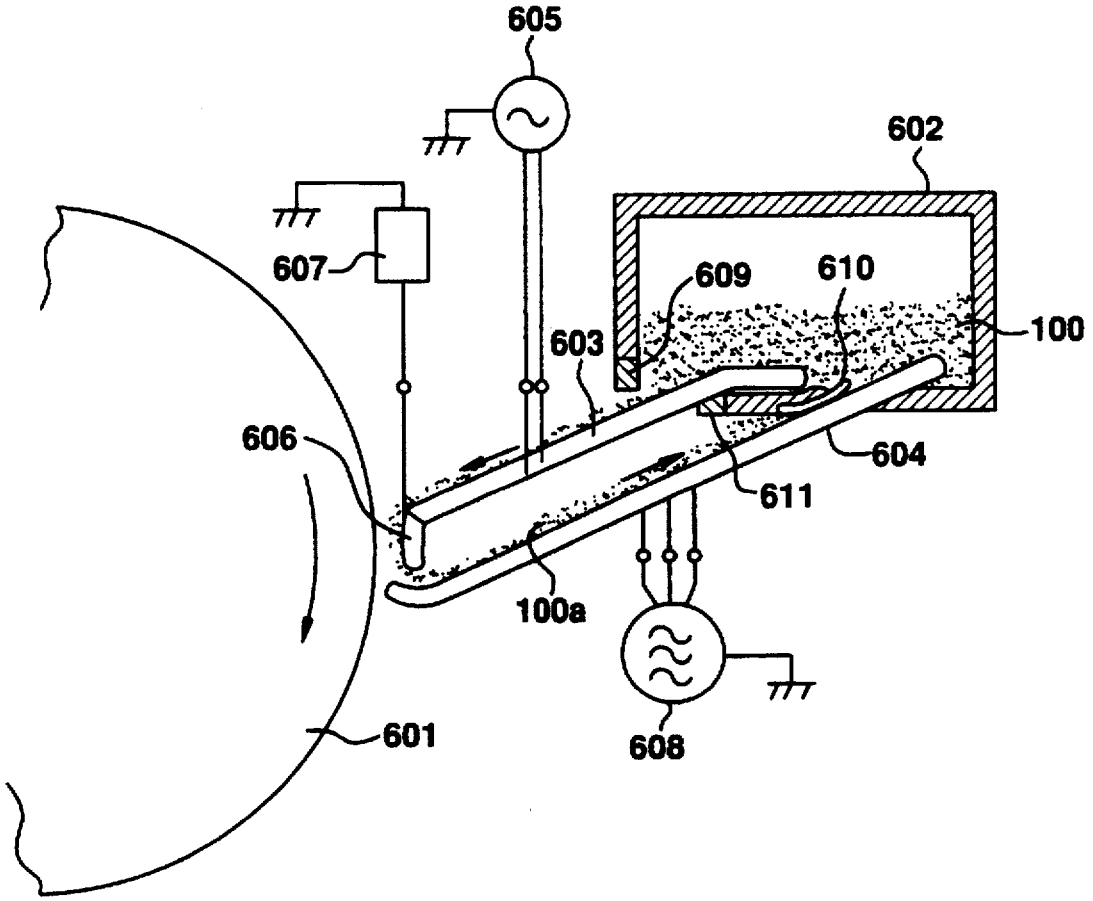
FIG. 10 is a diagram showing a third embodiment of the present invention.

Next will be described a third embodiment of the present invention with reference to FIG. 10.

A developer storing section 602 is provided at a prescribed distance from a drum-shaped image carrier 601, which may be a photosensitive drum for example. The developer storing section 602 is arranged in a higher position than the image carrier 601. Incidentally, the image carrier 601 need not be drum-shaped, but may be belt-shaped.

Between the developer storing section 602 and the image carrier 601 are arranged a carrying path 603 for carrying a developer 100 from the developer storing section 602 to the image carrier 601 and a recovering path 604, provided below the carrying path 603, for recovering the unused developer 100*a* and returning it to the developer storing section 602.

Figure 5:
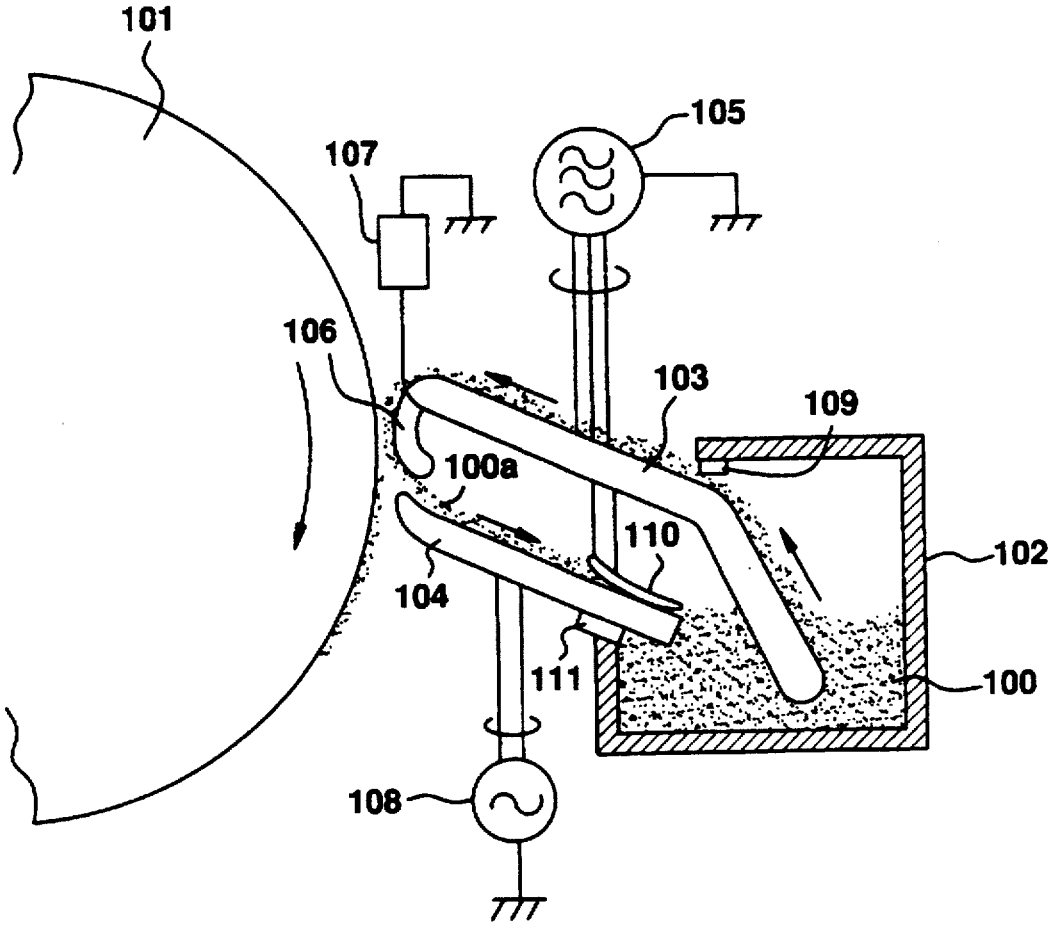
FIG. 5 is a diagram showing a first embodiment of the present invention.

The carrying path 603, having a similar structure to the recovering path 104 shown in FIG. 7, is arranged with an inclination reverse to that of the carrying path 103 shown in FIG. 5 from the developer storing section 602 toward the image carrier 601 arranged underneath. Furthermore, as illustrated in FIG. 10, the carrying path 603 is bent so that its end toward the developer storing section 602 reach the bottom of the developer storing section 602. A high-frequency voltage supplied from a power source 605 is applied to electrodes buried in the carrying path 603.

At the end of the carrying path 603 toward the image carrier 601 is provided a developing electrode 606, opposite to the image carrier 601 and directed downward. A bias voltage is fed to the developing electrode 606 from a developing power source 607.

The recovering path 604 has a similar structure to that of the carrying path 103 shown in FIG. 6. The recovering path 604 is arranged substantially in parallel to the carrying path 603, and accordingly can successively recover the unused developer 100 which drops from the developing electrode section 606 and continuously carry it to the developer storing section 602. In order to generate an electric field curtain over the recovering path 604, an A.C. voltage is applied to electrodes buried in the recovering path 604 from a power source 608.

Furthermore, the developing apparatus which is this third embodiment of the present invention is provided with a developer layer thickness regulating plate 609, a recovery sheet 610 and a seal pad 611 as substantially similar constituent elements to their respective counter-parts in the above-described first and second embodiments of the invention.

Next will be described the operation of the third embodiment of the present invention.

Upon the start of image forming operation, the output from the power source 605 is applied to the group of electrodes provided within the carrying path 603. Then the developer 100 in the developer storing section 602, passing between the carrying path 603 and the developer layer thickness regulating plate 609, is carried over the carrying path 603 toward the developing electrode 606 while being charged.

The developer 100 carried to the developing electrode 606 is used for development in a similar operation to that of the first preferred embodiment of the present invention, and an electrostatic latent image on the image carrier 601 is developed into a visible image. The visible image is delivered to a process of transcription to a recording medium or the like. Meanwhile, the developer 100 which has not been used in the development drops from the developing electrode 606 onto the recovering path 604, and is recovered into the developer storing section 602 by the action of the recovering path 604.

In the recovering path 604, the output from the power 608 is fed to the group of electrodes provided within the recovering path 604 to generate an electric field curtain action, and the action of the electric field curtain thereby generated causes the developer 100 on the recovering path 604 to pass under the recovery sheet 610 and to be recovered into the developer storing section 602. The recovered developer 100 will be used again in the next round of development. The operation of the developing apparatus thereafter continues by repeating the above-described sequence.

Thus the third embodiment of the present invention can use the developer 100 in the developer storing section 602 efficiently and effectively because the developer 100 can be carrier out of the bottom of the developer storing section 602.

The present invention is not limited to the above-described embodiments thereof. For instance, a belt- or sheet-shaped, instead of a drum-shaped, photosensitive or dielectric body may be used as image carrier. The shape of the carrying path and the recovering path need not be flat, but may be curved if appropriate for the overall configuration of the apparatus.

It is also possible to architect an apparatus to form color images by arranging a plurality of powder developing units differing in the color of developer. Furthermore, the output of the power source to generate an electric field curtain action is not limited to a sine wave, but may be a triangular wave or a rectangular wave of a combination thereof.

The carrying path and the recovering path in the first or third embodiment of the invention may have the structure illustrated in FIG. 9. Alternatively, the carrying path and the recovering path in the second embodiment of the invention may have the structure shown in FIG. 7.

What is claimed is:

1. A developing apparatus for developing electrostatic images formed on an image carrier by making a developer carried from storing means adhere to said image carrier, comprising:

carrying means, having means for generating an electric field curtain, for carrying said developer from said storing means by using said electric field curtain;

adhering means, arranged at the end of said carrying means toward said image carrier opposite to said image carrier and in a downward direction, for making the developer carried by said carrying means adhere to said image carrier; and recovering means, arranged below said adhering means, for recovering the developer which drops from said adhering means and carrying the developer to said storing means.

2. The developing apparatus, as claimed in claim 1, wherein:

said carrying means comprises a first plate shape member, said recovering means comprises a second plate shape member, and said second plate shape member is arranged substantially in parallel to said first plate shape number.

3. The developing apparatus, as claimed in claim 1, wherein said carrying means comprises:

a substrate; and an insulating layer which is arranged on said substrate and in which are buried a plurality of electrodes for generating said electric field curtain.

4. The developing apparatus, as claimed in claim 1, wherein said recovering means comprises means for vibrating the developer which is carried to said storing means.

5. The developing means apparatus, as claimed in claim 4, wherein:

at least one of said carrying means and said recovering means comprises both of said means for generating the electric field curtain and said means for vibrating the developer.

6. The developing apparatus, as claimed in claim 1, wherein said recovering means comprises:

a substrate; and a piezoelectric element sandwiched between electrode layers from above and below, arranged on said substrate.

7. The developing apparatus, as claimed in claim 1, wherein:

said storing means is arranged at a position lower than said image carrier, and said carrying means is arranged with an inclination from within said storing means to the vicinity of said image carrier.

8. The developing apparatus, as claimed in claim 7, wherein:

said carrying means is bent within said storing means, and the angle of its inclination within said storing means is greater than that outside the storing means.

9. The developing apparatus, as claimed in claim 1, wherein at least one of said carrying means and said recovering means comprises:

a substrate;

an insulating layer which is arranged on said substrate and in which are buried a plurality of electrodes for generating said electric field curtain; and a piezoelectric element sandwiched between electrode layers from above and below, arranged on said substrate.

10. The developing apparatus, as claimed in claim 1, wherein said carrying means comprises a first plate shape member which is arranged substantially horizontally from within said storing means to the vicinity of said image carrier.

11. The developing apparatus, as claimed in claim 10, wherein said carrying means is bent within said storing means and arranged with an inclination within said storing means.

12. The developing apparatus, as claimed in claim 10, wherein, said recovering means comprises a second plate shape member which is arranged substantially in parallel to said first plate shape member and substantially horizontally.

13. The developing apparatus, as claimed in claim 1, further comprising:

means for adjusting layer thickness of the developer, carried from said storing means toward said image carrier, over said carrying means.

14. A developing apparatus for developing electrostatic images formed on an image carrier by making a developer carried from storing means adhere to said image carrier, comprising carrying means for carrying said developer from said storing means to said image carrier; adhering means, arranged at the end of said carrying means toward said image carrier opposite to said image carrier and in a downward direction, for making the developer carried by said carrying means adhere to said image carrier; and recovering means, arranged below said adhering means, for recovering the developer which drops from said adhering means and carrying the developer to said storing means, wherein:

both of said carrying means and said recovering means comprises a plurality of first electrodes for generating an electric field curtain and a plurality of second electrodes for vibrating the developer, buried into them, said first electrodes are applied an A.C. voltage from a first power source, and said second electrodes are applied a high-frequency voltage from a second power source.

15. The developing apparatus, as claimed in claim 14, wherein both of said carrying means and said recovering means comprises:

a substrate;

an insulating layer which is arranged on said substrate and in which are buried a plurality of said first electrodes for generating said electric field curtain; and a piezoelectric element sandwiched between said second electrodes from above and below, arranged on said substrate.

16. The developing apparatus, as claimed in claim 14, wherein:

one end of said carrying means is arranged within said storing means and the other end is arranged horizontally in the vicinity of said image carrier; and one end of said recovering means is arranged in the vicinity of said image carrier and the other end is arranged horizontally within said storing means to be in parallel to said carrying means.

17. A developing apparatus for developing electrostatic images formed on an image carrier by making a developer adhere to said image carrier, comprising:

storing means, arranged in a higher position than said image carrier, for storing said developer;

carrying means, having means for carrying said developer from said storing means to said image carrier;

adhering means, arranged at the end of said carrying means toward said image carrier opposite to said image carrier and in a downward direction, for making the developer carried by said carrying means adhere to said image carrier; and recovering means for recovering the developer which drops from said adhering means and carrying the developer to said storing means.

18. The developing apparatus, as claimed in claim 17, wherein:

said carrying means is arranged with an inclination by a prescribed angle between the inside of said storing means and the vicinity of said image carrier.

19. The developer apparatus, as claimed in claim 18, wherein:

one end of said carrying means is arranged within said storing means and the other end is arranged in the vicinity of said image carrier; and one end of said recovering means is arranged within said storing means and the other end is arranged in the vicinity of said image carrier with an inclination to be substantially in parallel to said carrying means.

20. The developing apparatus, as claimed in claim 17, wherein:

said carrying means comprises means for vibrating said developer, and said recovering means comprises means for generating an electric field curtain.

21. The developing apparatus, as claimed in claim 17, wherein:

said carrying means comprises a first substrate and a piezoelectric element arranged on said first substrate and sandwiched between electrode layers from above and below, and said recovering means comprises a second substrate and an insulating layer which is arranged on said second substrate and in which are buried a plurality of second electrodes for generating an electric field curtain.

22. The developing apparatus, as claimed in claim 17, wherein:

at least one of said carrying means and said recovering means comprises both of means for generating an electric field curtain and means for vibrating the developer.

23. The developer apparatus, as claimed in claim 17, wherein:

at least one of said carrying means and said recovering means comprises:

a substrate, an insulating layer which is arranged on said substrate and in which are buried a plurality of first electrodes for generating an electric field curtain, and a piezoelectric element arranged on said insulating layer and sandwiched between second electrodes from above and below.

* * * * *

UNITED STATES PATENT AND TRADEMARK OFFICE

CERTIFICATE OF CORRECTION

PATENT NO. : 5,761,591
DATED : June 2, 1998
INVENTOR(S) : Chiseki YAMAGUCHI

It is certified that error(s) appears in the above-identified patent and that said Letters Patent is hereby corrected as shown below:

Column 4, line 32 delete "shaving" and insert --showing--.
Column 6, line 54 delete "(Miz)" and insert --($MH_z$)--.

Signed and Sealed this

Fifteenth Day of December, 1998

Bruce Lehman

*Attest:*

BRUCE LEHMAN

*Attesting Officer*

*Commissioner of Patents and Trademarks*